United States Patent [19]

Torgow

[11] Patent Number: 4,595,202

[45] **Date of Patent: * Jun. 17, 1986**

[54] GAME APPARATUS UTILIZING A BALL CONTROLLED ELECTRICAL SWITCH

[76] Inventor: Abraham Torgow, 25 Concord Cir., Howell, N.J. 07731

[ * ] Notice: The portion of the term of this patent subsequent to Oct. 16, 2001 has been disclaimed.

[21] Appl. No.: 621,513

[22] Filed: Jun. 18, 1984

Related U.S. Application Data

[63] Continuation-in-part of Ser. No. 222,667, Jan. 2, 1981, Pat. No. 4,477,078, which is a continuation of Ser. No. 23,730, Mar. 26, 1979, Pat. No. 4,264,073.

[51] Int. Cl.[4] ..... A63F 7/30

[52] U.S. Cl. ..... 273/122 A; 273/127 C; 273/DIG. 26

[58] Field of Search ..... 273/118 A, 118 D, 119 A, 273/120 A–127 A, 127 C, 141 A, 142 HA, DIG. 26

[56] References Cited

U.S. PATENT DOCUMENTS 4,477,078 10/1984 Torgow ..... 273/122 A

*Primary Examiner*—Richard C. Pinkham
*Assistant Examiner*—Vincent A. Mosconi

[57] ABSTRACT

A game apparatus consisting of a housing with a game playing surface. A ball is rolled on the playing surface by a conventional shooting device. The playing surface has openings and the ball, propelled from the front towards the rear end, falls into one of the openings, enters into the interior of the housing and rolls back towards the front end. One opening towards the rear end is designated as a "functional" opening and the interior of the housing has electrical wiring and a switching device for starting and stopping a motor which rotates a multi-disc assembly whenever the ball falls into the "functional" opening.

9 Claims, 7 Drawing Figures

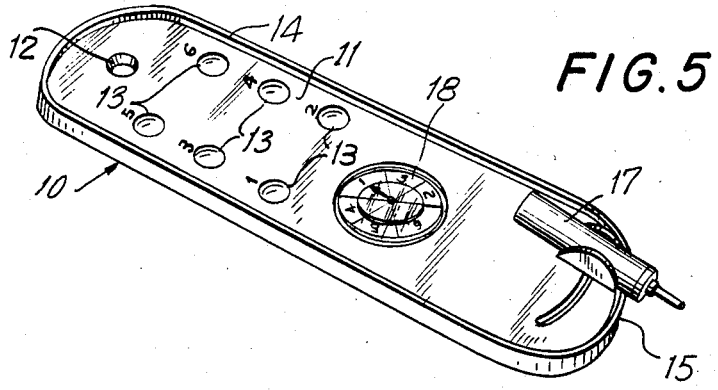
FIG. 5
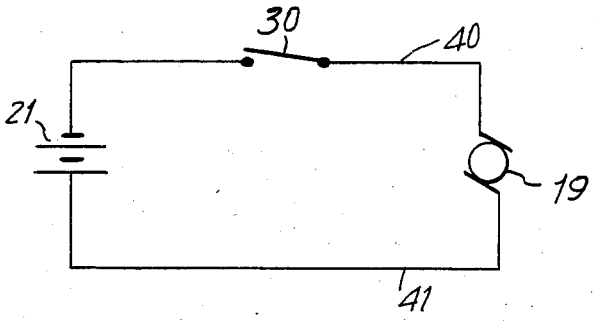
FIG. 4
FIG. 6
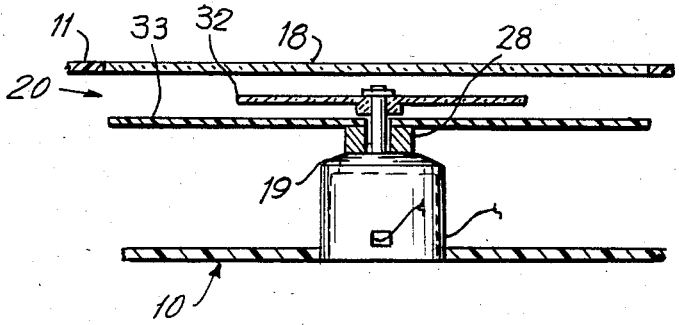
FIG. 7
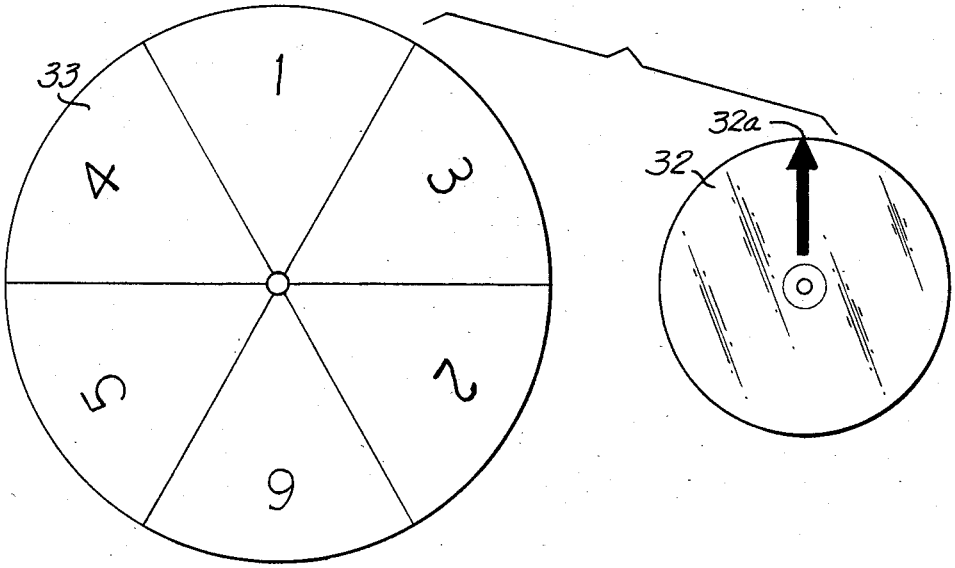

GAME APPARATUS UTILIZING A BALL CONTROLLED ELECTRICAL SWITCH

This application is a continuation-in-part of my copending application Ser. No. 222,667 filed on Jan. 2, 1981 now U.S. Pat. No. 4,477,078 which, in turn, is a continuation of Ser. No. 023,730, filed Mar. 26, 1979, now U.S. Pat. No. 4,264,073 granted Apr. 18, 1981.

REFERENCES CITED

| | | | |
|---|---|---|---|
| | U.S. PATENT DOCUMENTS | | |
| 1,614,471 | 1/1927 | Hayashi | 273/125 A |
| 2,004,990 | 6/1935 | Kirk et al. | 273/125 A |
| 2,418,598 | 4/1947 | Nicolaus | 273/125 A |
| 2,541,266 | 2/1951 | Metz | 273/124 A |
| 3,034,790 | 5/1962 | Breitenstein | 273/118 A |
| 3,348,844 | 10/1967 | Lemelson | 273/121 A |
| | FOREIGN PATENT DOCUMENTS | | |
| 0504979 | 5/1939 | United Kingdom | 273/123 A |

SUMMARY OF THE INVENTION

In its broadest aspect, the game apparatus of the invention comprises:

(I) A ball (II) A means for propelling said ball (III) A housing having an opening dimensioned to permit passage of a ball.

(IV) An elongated support means positioned to receive said ball which has passed through said opening.

(V) An indicator coupled for activation by an electric powered device.

(VI) A source of electric current (VII) And electrical wiring connecting said current source, said supporting means, and said electrical powered device; said support means being adapted upon receiving said ball to complete a current feed circuit to said powered device and to maintain said current feed circuit for at least a portion of time during which said ball will roll along said support means.

In a first embodiment, said support means apparatus, as claimed in claim 1, wherein said support means includes an elongated resiliently bendable strip mounted to a raised support means. The unsupported portion of said strip being resiliently movable with respect to said raised support means. Said movable portion carrying one of a pair of co-operating contacts arranged in said current feed circuit. Said movable portion of said strip having an unconstrained rest condition in which contacts are open, said movable portion of said strip being adapted upon receiving said ball to be moved to a constrained position of resilient deformation in which said contacts are closed and after said ball has rolled off the strip to be restored to said rest position, opening said electrical contacts.

BACKGROUND OF THE INVENTION

The invention relates to an apparatus for playing a game which combines intellectual decision making and physical skill. An electrical circuit is energized by a marble size ball rolling on an elongated ball support. In U.S. Pat. No. 4,264,073 the ball is metal and the ball support consists of two conducting rails. The metal ball bridges the rails, there by energizing the circuit. In U.S. Pat. No. 4,477,978, the metal is replaced with a nonconducting glass type marble, and it's the weight of the marble rolling down the ball support that causes a pair of electrical contacts to close energizing the circuit.

OBJECTS OF THE INVENTION

It is the primary object of the present invention to provide a new electric game apparatus which comprises a ball propelling device, a housing having an opening to allow the ball to enter the interior of the housing and, in turn, indicate a random score or action to be taken by each player, and means for the ball to roll out of the housing.

Another object of the invention is to provide a new electric time switch to be actuated by the ball whenever the ball has passed through one designated opening and, in turn, to energize a random indicator assembly.

Another objective of this invention is to provide a cost effective electric game that avoids the need for mechanical linkage, solenoids, gears or relays.

BRIEF DESCRIPTION OF THE DRAWINGS

In the drawings:

FIG. 4 is a wiring schematic showing the switch electrical circuit;

FIG. 5 is a perspective view of one embodiment of the upper housing member;

FIG. 6 is a fragmentary cross sectional view of the random indicator disks and the motor;

FIG. 7 is a plan view of the two disks employed with the game.

DESCRIPTION OF THE PREFERRED EMBODIMENT

Figure 2:
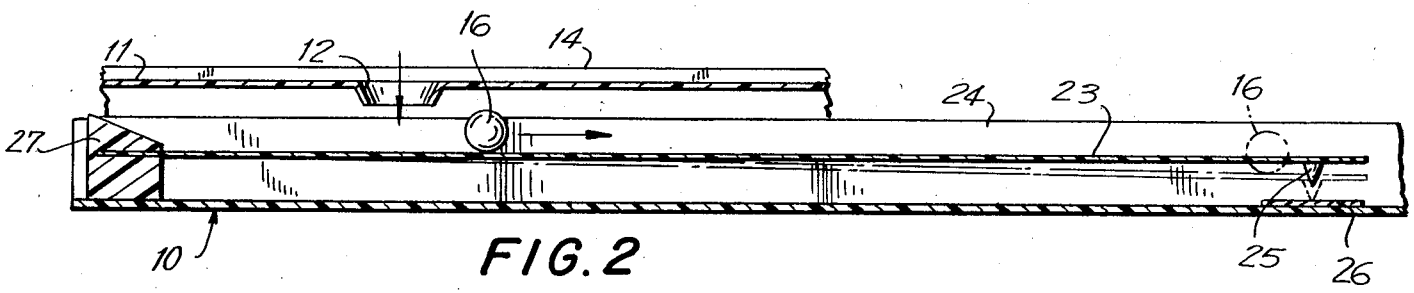
FIG. 2 is a cross section taken generally along the line 2—2 of FIG. 1.

As shown in FIG. 5, a housing structure 10 has a game-playing top surface 11, a circular first opening 12 towards the rear end of the playing surface which is designated as "functional opening", six numbered second circular openings 13, a side retaining wall 14 projecting above the playing surface 11, a large front-end opening 15 and a transparent circular window 18. A ball 16 is called on the playing surface 11 from the front end towards the openings 12 and 13 by use of an aimable ball projecting device 17. The ball 16 can fall into any one of the openings 12 and 13, enter the interior of the housing and then roll out of the housing through the front end opening 15. The housing 10 can be constructed with a small inclination so that the ball 16 will roll out of the interior of the housing under gravity.

The size of the openings 12, 13 is related to the size of the ball; for a ball having a half-inch diameter, the circular openings have a diameter of 1–1.5 inches. Also, the openings 13 can have ball cups mounted within them so that the ball 16 is removed manually therefrom. A perspective view of the interior of the housing 10 as shown in FIG. 1 indicates that the housing is equipped with a d.c. motor 19 for rotating a multi-disc assembly 20 shown in FIG. 6, curved channel walls 22–24 for guiding the ball 16 to roll on a curved resilient plastic strip 23, to act as a movable switch member contact whenever the ball enters the "functional" opening 12 which is shown in FIG. 5.

The electrical circuit diagram for the d.c. motor 19 is shown in FIG. 4. The switch 30 includes the resilient plastic strip 23 which can be moved by the ball 16. The source of electricity could be a battery 21 as shown in FIG. 1 or several batteries connected together, or any other suitable source of electrical energy with the appropriate electrical wiring to ensure the safety of the players.

Figure 1:
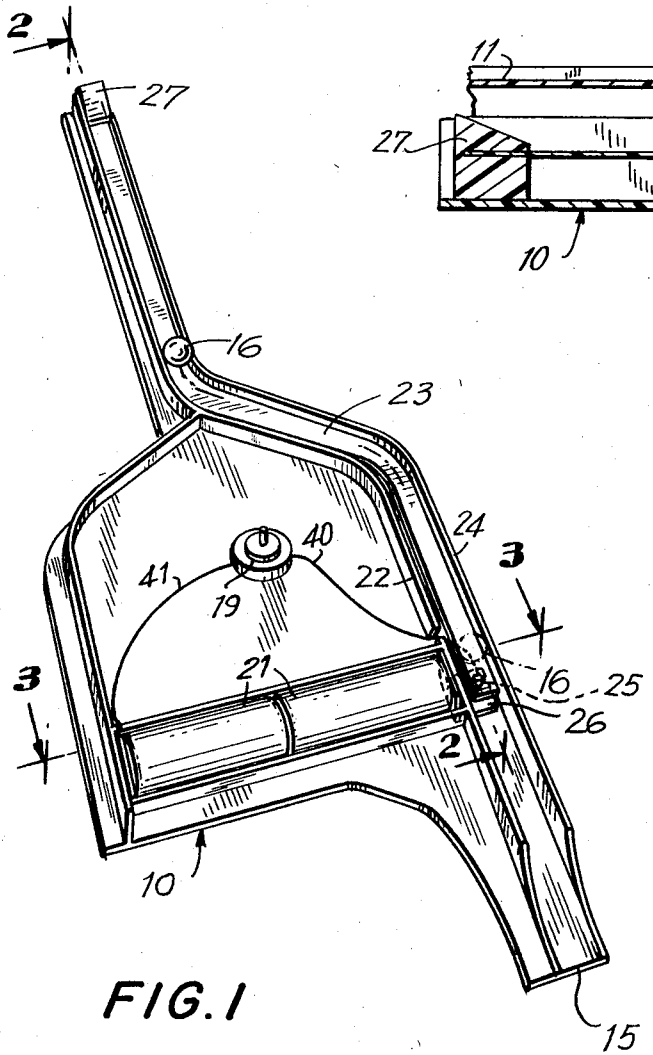
FIG. 1 is a perspective view of the lower housing member.

The ball 16, upon entering the "functional" opening 12, falls into the channel 22–24 and is guided on the resilient plastic strip 23 as shown in FIG. 1. Since the entire game apparatus has a small inclination towards the front end, the ball will roll in that direction on the plastic strip 23. The plastic strip is fastened on a strip support block 27.

The channel 22–24 in FIG. 1 and the resilient strip 23 are curved to guide the ball 16 around the motor-disk assembly 19–20 and the batteries 21 to the front end opening 15 on the side of the housing in FIG. 1.

Figure 3:
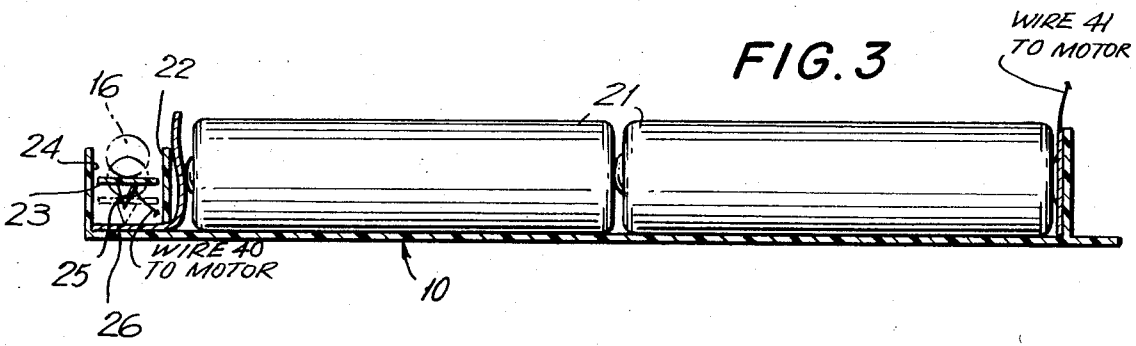
FIG. 3 is a cross section taken generally along the line 3—3 of FIG. 1.

An electrically conductive metal plate 25 having a sharp edge or peak is fastened on the plastic strip 23 at its front end and connected to the electrical motor 19 by a flexible wire 40, and an electrically conductive flat metal plate 26 is positioned under the sharp edge of the plate 25 and fixed on the base of the housing as shown in FIG. 3. The metal plates 25 and 26 are wired into the electrical circuit of the motor 19 to form switch 30 and normally no electric current flows across them when the strip 23 is in raised position. Whenever the ball rolls onto the plastic strip 23, the weight of the ball presses down the front end of the plastic strip and thus closes the electrical circuit through the battery wire 41, to the motor 19. As the ball rolls off the plastic strip 23, the strip springs back to its normal raised position, and the electric circuit for the motor is broken again.

The switch 30 is closed only for a brief period of time; the time should be sufficiently long (1–2 sec.) to turn on the motor 19 and, in turn, spin the multi-disc assembly 20. The time can be adjusted to the desired period by increasing or decreasing the inclination of the game apparatus and/or support 27 for the plastic strip; also, the length and shape of the plastic strip 23 and channel 22, the weight of the ball, and its surface roughness will affect the time period of maintaining a closed circuit for the motor.

The multi-disc assembly 20 consists of two discs as shown in FIG. 6. One disc 32 is fastened to the shaft of the motor 19 and rotates at the speed of the shaft. The other disc 33 rotates at random speed depending on the friction between it and the disc 32 fastened to the motor shaft. Disc support 28 separates the disc 33 from the motor 19.

Depending on the rules of the game, the disc 33 has graduations with various combinations of numbers and shapes. For example, if the rules to be followed by the players are for a dice game, the disc 33 will be graduated with numbers from one to six or a dice shape with the appropriate number of dots from one to six. The disc 32 is an indicating disc and is made of a transparent material; the image of an arrow 32*a* is inscribed on its surface and serves as the indicator of the score point or combination of numbers and shapes inscribed on the surface of the graduated disc 33 whenever the multi-disc assembly 20 comes to rest after each spinning.

The indicating disc 32 can be replaced by a disc having values imprinted thereon, disc 33 being removed and an arrow shape can be inscribed on the transparent window 18 and serve as the indicator to score point.

STRIP DESIGN CONSIDERATIONS

The plastic strip 23 must be molded or otherwise formed to overcome the tendency of a thin, long strip, supported on one end to droop along its length. The strip dimensions in conjunction with the structural forming, gives the strip the resiliency to bend under the weight of the ball 16 and to spring back to its unburdened state.

The plastic strip 23 must be thin and light in weight to enable the weight of the ball 16 to move the strip 23 downward. However, if the strip 23 is too light and thin, it will bottom out under the weight of the ball. The strip will go into a bowlike configuration, one end of the strip 23 being supported by the support member 27 and the other end by the closed electrical contacts 25–26. The ball will stop rolling and the circuit to the motor will not open up.

The plastic strip 23 must be elongated to enable the ball's rolling time to be of a sufficient duration for the motor to reach a high speed. Also, the downward moment of force generated by the rolling ball 16 is a function of the length of the strip 23. However, if the strip 23 is too long, it will not stay extended.

Another design consideration is the downward slope of the strip 23. If the slope is too shallow the ball 16 will not roll. If the scope is too steep, the ball 16 will speed down the strip 23, shortening the closed contact 25–26 time period.

Another design consideration is the curvature of the strip 23, in conjunction with the curvature of the channel walls 22–24, in that it enables the ball 16 to enter a centrally located function target opening 12 (FIG. 5) and to exit out of the front end opening 15 (FIG. 1) located on the side of the housing (FIG. 1). This displacement permits the strip 23 to have a maximum elongation within the geometry of the housing (FIG. 1).

This construction also simplifies the placement of the motor-disc assembly 19–20 and the batteries 21. The wiring is reduced in that the contact 26 serves as both a battery connection and as the lower contact for the switch 30 (FIG. 1).

STRIP CONSTRUCTION

In one embodiment, the plastic strip 23 is 18 inches in length, $\frac{3}{8}$" wide, and 1/16" thick, its total weight being less than three quarters of an ounce. The strip 23, being heated and bent upwards, then quenched with water, so that the end result of this process is a plastic strip 23 that when attached to a supporting member 27 at one end will extend horizontally without dropping through out its length, but will move downward when burdened with the weight of the ball 16.

The strip 23 is attached to a strip supporting member 27 which is 1" in height. The movable contact is attached to the unsupported portion of the strip. This contact extends downward for half an inch. When the ball 16 is on the surface of the strip 23, the strip 23 will move downward until its motion is halted by the contacting contacts. At this point, the strip 23 will have a downward slope ratio of 36:1. This angle of declination enables the ball 16 to roll down the strip 23 at a useful rate of descent. The time for the ball to roll down the strip is approximately 1–2 seconds.

The strip 23, when used as a time switch, functions correctly in energizing the electrical circuit for a time period sufficient to allow the electrical motor to reach a high speed before the circuit deactivates, using balls 16 that can range in weight from 3/16 to ¼ of an ounce.

The electrical motor used in one embodiment is a standard three volt D.C. 1800 revolution per second toy motor.

The game apparatus of my invention is used in play for a dice game as follows:

The player aims with the shooting device to introduce the ball into the "functional" opening. If he succeeds, the multi-disc assembly will be spun for 1–2 sec. and then come to rest; a number (e.g., 3) will be indicated on the graduated disc. The player, in order to win, must then aim to shoot the next balls into the opening designated by the numeral 3 as shown on the game-playing surface.

The description of the playing of the game has been brief and is merely exemplary. Many rule modifications are possible.

While this invention has been shown in the best form known, it will be nevertheless understood that this is purely exemplary. The heat-formed plastic strip 23 which serves as the resilient arm of the switch 30 can be a molded piece or a structurally molded part of the housing shown in FIG. 1. The strip can also be made out of resilient material other than plastic without departing from the scope of the invention as defined in the appended claims.

Likewise, the motor driven random indicator can be replaced with a solid state timer, using light-emitting indicators, the timer's count being a function of the ball activating a voltage level while rolling down the strip, without departing from the scope of the invention as defined in the appended claims.

I claim:

1. An apparatus for playing a game, comprising:

(i) a housing structure, said housing structure having an entry opening, said entry opening being adaptable to afford passage of a ball, (ii) an elongated ball guiding means extending from a first end to a second end, said guiding means including a chute portion positioned below said entry opening and adapted to cause a ball dropping onto said chute portion to roll therealong towards said first end, said first end having a ball exit opening for said ball to be withdrawn from said housing, said ball guiding means including a ball support which is resiliently urged to a raised position, said support being adapted to be moved downward to a lowered position by the weight of a ball received thereon, said ball support being elongated and extending along a major portion of the length of said chute portion such that when a ball is received on said support it is moved to a lowered position for a period of time determined by the ball rolling along the support and passing off an end thereof, said chute being adapted to contain said ball on said ball support, said chute and said ball support path being configured so as to permit a useful ball support length without conflicting with the best structural locations for the placement of the other parts that go into the games construction, said ball support having a length that in conjunction with its downward slope is such that said ball rolling down its surface will roll for at least one-half of a second before it rolls off the ball support end, said downward slope having a declination of less than 15 degrees, said ball support's movable portion being at least 8 inches but no more than 30 inches in length, said ball support's movable portion weighing no more than 2 ounces, (iii) an electric powered device and, (iv) a source of electrical current, a switch means associated with said ball support and arranged to be open when said ball support is not in lowered position and to be closed when said ball support is not in raised position, (v) electrical wiring connecting said switch means and said electrical powered device and terminals for connection to a current source such that a current circuit is completed to said electric powered device when said switch means is closed by the presence of a ball rolling on said support, said switch means comprising a first electrical contact carried by said ball support, and a second electrical contact adapted to complete an electrical connection with said first contact.

2. An apparatus as claimed in claim 1 wherein said housing structure has a transparent window portion as part of its outer wall.

3. An apparatus as claimed in claim 1 wherein said game apparatus includes a ball and a ball propelling device.

4. An apparatus as claimed in claim 1 wherein said electric powered device is an electric motor coupled to cause a rotor indicator to spin.

5. An apparatus as claimed in claim 1, wherein said electric powered device is an electronic solid state pulse generator, said pulse generator's pulse count being a function of said switch means being closed by the presence of said ball on said switch means ball support, said pulse generator having a light-emitting illuminating means to indicate said random pulse count.

6. An apparatus for playing a game, comprising:

(i) a housing structure, with an upper wall extending in the direction from a first end to a second end, and forming a top playing surface, said upper wall having therein a transparent window portion and said upper wall also having therein an entry opening, said entry opening being dimensioned to permit passage of a ball propelled into said opening, and an upstanding wall bounding said top playing surface at least at said second end, (ii) an elongated ball guiding means disposed below said playing surface, said ball guiding means being positioned below said opening and extending towards said first end, said guiding means including a ball support, said guiding means being adapted to receive a ball entering said entry opening and causing said ball to roll by gravity on said ball support to an exit opening on said first end, said guiding means having such a configuration that will enable a useful ball support length without conflicting with the best location of the other parts that go into game's construction, said ball support having a length that in conjunction with its downward slope is such that said ball rolling down its surface, will roll for at least ½ of a second before it rolls off the ball support end, said downward slope having a declination of less then 15 degrees, (iii) an indicator coupled for actuation by an electric motor, (iv) a source of electrical current, and (v) electrical wiring connecting said current source to an electrical contact means, said contact means being adaptable to bridge said current feed to said electrical motor by the presence of said ball rolling on said ball support, (vi) said indicator being positioned below said transparent window portion, said indicator consisting of rotor element, said rotor element being driven by said electric motor, said rotor element having the means to indicate an unforcastable score when said current source to the motor circut is broken.

7. An apparatus as claimed in claim 6 wherein said indicator is positioned below said window portion, and coupled for actuation by said electric motor, said indicator comprising a first rotor element rotatable about an axis, a second rotor element rotatable about said axis, one of said rotors element having angularly spaced markings, the other said rotor element having an index marking, for indicating unforcastable respective markings which become aligned therewith, when said current source to the motor circuit is broken, said rotor elements having a variable slipping drive means acting between them, and one said rotor element being driven by said motor means.

8. An apparatus as claimed in claim 6 wherein said game apparatus included a ball propelling device.

9. An apparatus as claimed in claim 6 wherein said elongated ball guiding means having such a deviation from a straight path of travel that will enable an optimum ball support length without conflicting with the best location of the other parts that go into the games construction.

* * * * *